US009048059B2

(12) United States Patent
Jeong et al.

(10) Patent No.: US 9,048,059 B2
(45) Date of Patent: Jun. 2, 2015

(54) STACKED X-RAY TUBE APPARATUS USING SPACER

(75) Inventors: Jin Woo Jeong, Daejeon (KR); Jun Tae Kang, Daegu (KR); Yoon Ho Song, Daejeon (KR); Jae Woo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 396 days.

(21) Appl. No.: 13/554,379

(22) Filed: Jul. 20, 2012

(65) Prior Publication Data

US 2013/0022173 A1 Jan. 24, 2013

(30) Foreign Application Priority Data

Jul. 22, 2011 (KR) ..... 10-2011-0073203

(51) Int. Cl.
*H01J 35/04* (2006.01)
*H01J 35/16* (2006.01)
*H01J 35/08* (2006.01)

(52) U.S. Cl.
CPC ..... *H01J 35/04* (2013.01); *H01J 35/08* (2013.01); *H01J 35/16* (2013.01); *H01J 2235/16* (2013.01)

(58) Field of Classification Search
CPC ..... H01J 35/04; H01J 35/16; H01J 35/08
USPC ..... 378/138, 122, 119, 121, 123, 136, 145, 378/137, 140
See application file for complete search history.

(56) References Cited

U.S. PATENT DOCUMENTS

| | | | | | |
|---|---|---|---|---|---|
| 2,862,107 | A * | 11/1958 | Cummings | 378/107 |
| 3,363,131 | A * | 1/1968 | Perry | 378/138 |
| 5,125,019 | A * | 6/1992 | Evain et al. | 378/137 |
| 5,227,699 | A * | 7/1993 | Busta | 315/291 |
| 5,534,747 | A * | 7/1996 | Carruthers | 313/456 |
| 5,729,583 | A * | 3/1998 | Tang et al. | 378/122 |
| 5,801,486 | A * | 9/1998 | Johnson et al. | 313/495 |
| 6,031,326 | A * | 2/2000 | Suzuki et al. | 313/414 |
| 6,626,724 | B2 * | 9/2003 | Yamamoto et al. | 445/24 |
| 6,661,876 | B2 * | 12/2003 | Turner et al. | 378/138 |
| 7,086,577 | B2 * | 8/2006 | Chornenky et al. | 228/256 |
| 7,508,917 | B2 * | 3/2009 | Dittrich et al. | 378/136 |
| 2003/0021377 | A1 * | 1/2003 | Turner et al. | 378/102 |
| 2003/0099327 | A1 * | 5/2003 | Matsushita et al. | 378/138 |

(Continued)

FOREIGN PATENT DOCUMENTS

| | | | |
|---|---|---|---|
| JP | 2007-066694 | A | 3/2007 |
| KR | 10-0867172 | B1 | 10/2008 |

(Continued)

*Primary Examiner* — Michael Logie
(74) *Attorney, Agent, or Firm* — Rabin & Berdo, P.C.

(57) ABSTRACT

The present disclosure relates to a stacked x-ray tube apparatus using a spacer, and more particularly, to a stacked x-ray tube apparatus using a spacer that makes it possible to reduce the size of an x-ray tube by forming a stacked structure, with electric insulation and predetermined gaps maintained for each electrode, by forming a stacked x-ray tube by inserting insulating spacers (for example, ceramic) between a exhausting port, a cathode, a gate, a focusing electrode, and an anode and bonding them with an adhesive substance, and then inserting a spacer between a field emitter on a cathode substrate and a gate hole connected with a gate electrode.

14 Claims, 3 Drawing Sheets

(56) References Cited

U.S. PATENT DOCUMENTS

| | | | | |
|---|---|---|---|---|
| 2005/0105690 | A1* | 5/2005 | Pau et al. | 378/145 |
| 2005/0231090 | A1* | 10/2005 | Chen et al. | 313/303 |
| 2005/0275331 | A1* | 12/2005 | Takai et al. | 313/311 |
| 2006/0274889 | A1* | 12/2006 | Lu et al. | 378/122 |
| 2008/0203886 | A1* | 8/2008 | Takai et al. | 313/311 |
| 2009/0010393 | A1* | 1/2009 | Klinkowstein et al. | 378/140 |
| 2009/0039754 | A1* | 2/2009 | Tolt | 313/310 |
| 2009/0161830 | A1* | 6/2009 | Inazuru | 378/138 |
| 2009/0185660 | A1* | 7/2009 | Zou et al. | 378/122 |
| 2010/0244717 | A1* | 9/2010 | Jeong et al. | 315/246 |
| 2011/0116603 | A1* | 5/2011 | Kim et al. | 378/119 |
| 2011/0188635 | A1* | 8/2011 | Cho et al. | 378/122 |
| 2012/0250827 | A1* | 10/2012 | Jeong et al. | 378/122 |
| 2012/0257721 | A1* | 10/2012 | Park | 378/123 |
| 2013/0028386 | A1* | 1/2013 | Jeong et al. | 378/122 |

FOREIGN PATENT DOCUMENTS

| | | | | |
|---|---|---|---|---|
| KR | 10-2010-0123987 | A | 11/2010 | |
| KR | 10-1040536 | B1 | 6/2011 | |
| WO | WO2009/078581 | A2 * | 6/2009 | H01J 35/04 |

* cited by examiner

STACKED X-RAY TUBE APPARATUS USING SPACER

CROSS-REFERENCE TO RELATED APPLICATIONS

This application is based on and claims priority from Korean Patent Application No. 10-2011-0073203, filed on Jul. 22, 2011, with the Korean Intellectual Property Office, the disclosure of which is incorporated herein in its entirety by reference.

TECHNICAL FIELD

The present disclosure relates to a stacked x-ray tube apparatus using a spacer, and more particularly, to a stacked x-ray tube apparatus using a spacer that makes it possible to reduce the size of an x-ray tube by manufacturing an x-ray tube in a stacked structure, with electric insulation and predetermined gaps maintained for each electrode, by manufacturing an x-ray tube having a stacked structure by inserting insulating spacers (for example, ceramic) between a exhausting port, a cathode, a gate, a focusing electrode, and an anode and bonding them with an adhesive substance, and then inserting a spacer between a field emitter on a cathode substrate and a gate hole connected with a gate electrode.

BACKGROUND

Common X-ray tubes generate X-rays by hitting electrons against a metal anode target with high energy. For example, an x-ray tube uses a principle of generating Bremstralung x-rays or specific x-rays generated, depending on the substance of the anode target. The electron source that emits electrons is usually a thermal electron source.

Meanwhile, there is an x-ray tube emitting electrons by using nano-substances. The x-ray tube uses a field emitter. It is important in the x-ray tube using a field emitter to apply nano-substances, which are effective for field emission, to a cathode electrode, to form a gate electrode to apply an electric field to the nano-substance, and to seal the structure of the x-ray tube under vacuum.

However, the x-ray tube using a field emitter is necessarily equipped with various electrodes such as a gate electrode, an emitter electrode, an anode electrode and a cathode electrode. There is a problem in that it is difficult to reduce the size because the size of the x-ray tube is increased by various electrodes.

SUMMARY

The present disclosure has been made in an effort to provide a stacked x-ray tube apparatus using a spacer that makes it possible to reduce the size of an x-ray tube by forming a stacked structure, with electric insulation and predetermined gaps maintained for each electrode, by manufacturing an x-ray tube having a stacked structure by inserting insulating spacers (for example, ceramic) between a exhausting port, a cathode, a gate, a focusing electrode, and an anode and bonding them with an adhesive substance, and then inserting a spacer between a field emitter on a cathode substrate and a gate hole connected with a gate electrode.

An exemplary embodiment of the present disclosure provides a stacked x-ray tube apparatus using a spacer, including: a cathode configured to emit electrons through a field emitter formed on a cathode substrate; a gate configured to apply an electric field to the field emitter through a gate electrode with a gate hole; a focusing electrode configured to focus electrons generated from the cathode; and an anode configured to generate x-rays when the focused electrons hits on an anode target, in which the cathode, the gate, the focusing electrode, and the anode are bonded in a stacked structure by a plurality of spacers such that electric insulation and predetermined gas are maintained.

According to the exemplary embodiments of the present disclosure, it is possible to reduce the size of an x-ray tube by forming a stacked structure, with electric insulation and predetermined gaps maintained for each electrode, by manufacturing an x-ray tube having a stacked structure by inserting insulating spacers (for example, ceramic) between a exhausting port, a cathode, a gate, a focusing electrode, and an anode and bonding them with an adhesive substance, and then inserting a spacer between a field emitter on a cathode substrate and a gate hole connected with a gate electrode.

Further, according to the exemplary embodiments of the present disclosure, it is possible to easily manufacture a field emission x-ray tube with a plurality of electrodes in a stacked shape.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
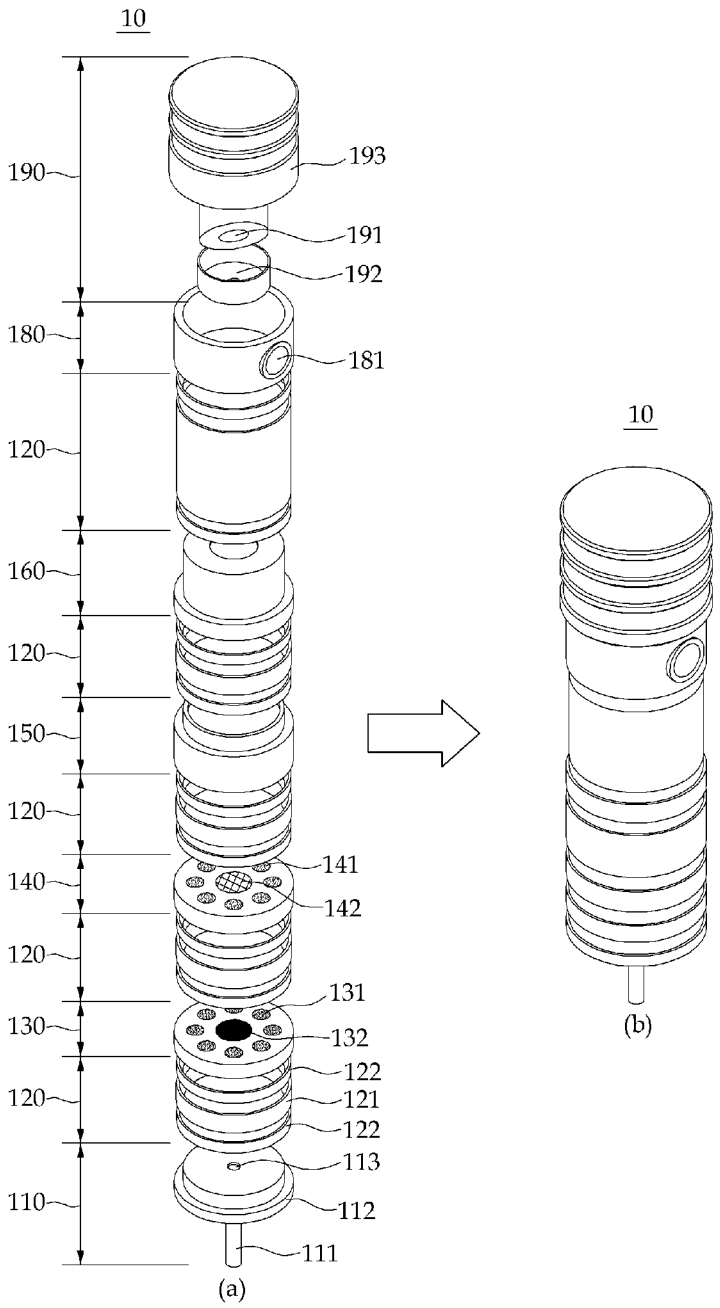
FIG. 1 is an assembly view of an exemplary embodiment of a stacked x-ray tube apparatus using a spacer according to an exemplary embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings. The configuration and the corresponding operational effect of the present disclosure will be clearly understood through the following detailed description. Before describing in detail the present disclosure, like components are indicated by the same reference numeral as much as possible even if they are illustrated in different figures and detailed description of well-known configurations is not provided when it is determined they may make the spirit of the present disclosure unclear.

FIG. 1 is an assembly view of an exemplary embodiment of a stacked x-ray tube apparatus using a spacer according to an exemplary embodiment of the present disclosure.

As illustrated in FIG. 1A, an x-ray apparatus 10 according to an exemplary embodiment of the present disclosure induces x-rays by using a field emitter 132 as an electron source. The x-ray tube apparatus 10 includes an exhausting unit 110, a plurality of spacer units 120, a cathode 130, a gate 140, a first focusing electrode 150, a second focusing electrode 160, an x-ray inducing unit 180, and an anode 190. The stacked x-ray tube apparatus 10 is assembled by combining the parts, as illustrated in FIG. 1B.

The exhausting unit 110 has an exhausting pipe 111 and an exhausting pipe connection portion 112. The spacer units 120 are each implemented by an insulating spacer 121 and bonded to the exhausting unit 110, the cathode 130, the gate 140, the first focusing electrode 150, the second focusing electrode 160, the x-ray inducing unit 180, and the anode 190 by an adhesive substance, at the upper end and the lower end. The cathode 130 has a exhausting hole 131 and a field emitter 132 formed on a cathode substrate. The gate 140 has a exhausting hole 141 and a gate hole 142. The x-ray inducing unit 180 has a window 181. The anode 190 has an anode target 191, an anti-back scattering cap 192, and an anode electrode 193.

The components of the stacked x-ray tube apparatus using a spacer according to an exemplary embodiment of the present disclosure is described hereafter.

The exhausting unit 110 exhausts air between the anode 190 and the cathode 130 through the exhausting pipe 111. The insulating spacers 121 of the x-ray tube apparatus 10 are bonded by an adhesive substance and the exhausting pipe 111 is sealed and cut after the air in the x-ray tube is extracted through the exhausting pipe 111 connected to the exhausting pipe connection portion 112 in manufacturing. This is for sealing the x-ray tube under vacuum. The exhausting pipe 111 is implemented by a glass pipe or an oxide free copper pipe that can be pinched off. The air in the space between the gate 140 and the anode 190 is exhausted to the exhausting pipe 111 through exhausting holes 131 and 141 formed at the gate 140 and the cathode 130, respectively.

The spacer units 120 are inserted and bonded in a stacked structure to the exhausting unit 110, the cathode 130, the gate 140, the first focusing electrode 150, the second focusing electrode 160, the x-ray inducing unit 180, and the anode by the adhesive substance 122 such that electric insulation and predetermined gaps are maintained.

The cathode 130 emits electrons through the field emitter 132 formed on a cathode substrate.

The gate 140 applies an electric field to the field emitter 132 through a gate electrode with the gate hole 142.

The first and second focusing electrodes 150 and 160 focus the electrons generated from the cathode 130.

The anode 190 generates x-rays when the electrons focused by the first and second focusing electrodes 150 and 160 hit on the anode target 191. The anode target 191 is made of tungsten or molybdenum.

The x-ray inducing unit 180 induces the electrons generated from the anode 190 to the outside through the window 181.

Meanwhile, the cathode 130, the gate 140, or the first and second focusing electrodes 150 and 160, which are bonded with the spacer units 120, each may include a guide covering the outer circumference of the insulating spacer 121 such that they are aligned in one line when being bonded with the adhesive substance 122. The insulating spacer 121 is made of ceramic in this configuration. The insulating spacer 121 is bonded with the cathode 130, the gate 140, or the first and second focusing electrodes 150 and 160 by the adhesive substance 122 made of frit glass or a brazing filler.

The cathode 130, the gate 140, or the first and second focusing electrodes 150 and 160, which are made of metal, except for the anode 190 and the exhausting unit 110, are made of a Kovar alloy having a coefficient of thermal expansion similar to that of ceramic to be bonded with ceramic.

Figure 2:
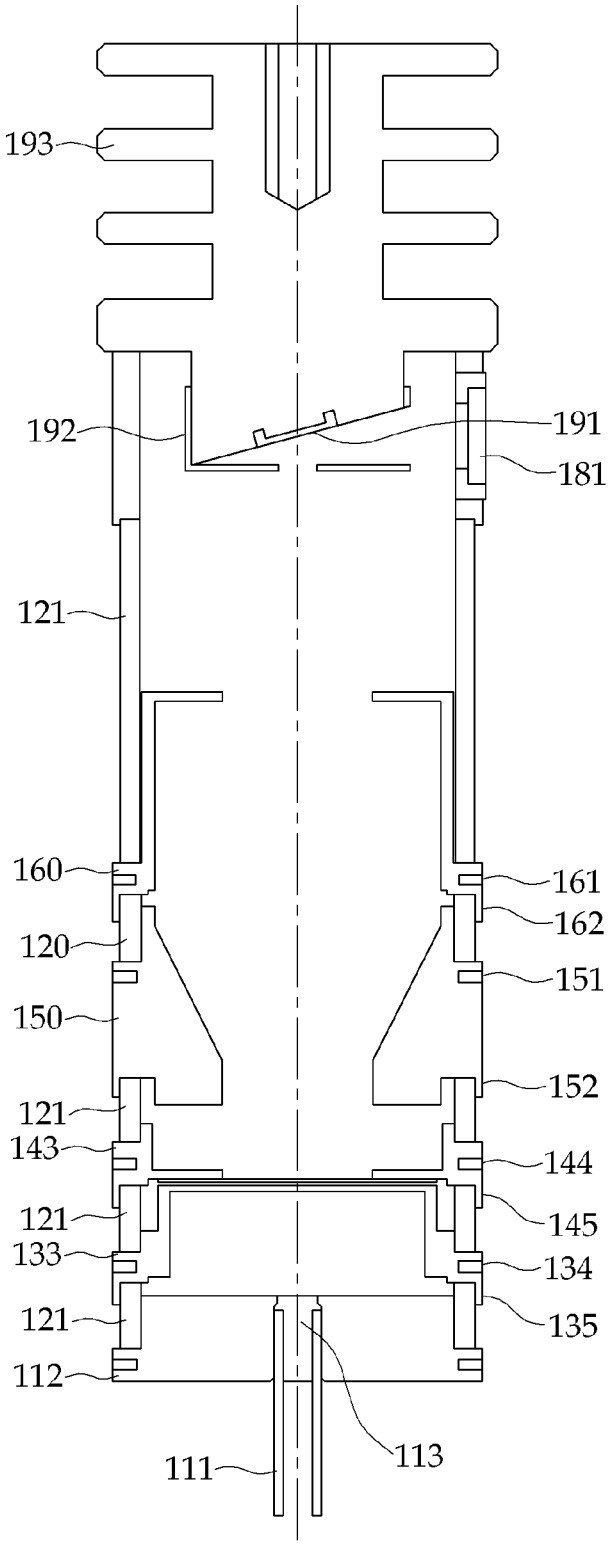
FIG. 2 is a cross-sectional view of an exemplary embodiment of a stacked x-ray tube apparatus using a spacer according to an exemplary embodiment of the present disclosure.

FIG. 2 is a cross-sectional view of an exemplary embodiment of a stacked x-ray tube apparatus using a spacer according to an exemplary embodiment of the present disclosure.

The anode 190 includes an anode target 191 and an anode electrode 193. The anode target may be made of tungsten or molybdenum or the like in accordance with the purpose of generating x-rays. The anode electrode 193 may be made of copper with high thermal conductivity.

The anode 190 may include an anti-back-scattering cap 192 with a small hole passing electrons. The anti-back scattering cap 192 is provided to prevent back scattering of electrons hitting on the anode target 191.

X-rays generated from the anode target 191 are induced to the outside of the x-ray tube through the window 181 made of beryllium or the like.

The air in the space between the gate electrode 143 and the anode electrode 193 is exhausted through the exhausting pipe 100 after passing through exhausting holes 141 and 131 formed at the gate electrode 143 and the cathode electrode 133.

The cathode 130, the gate 140, or the first and second focusing electrodes 150 and 160 that are bonded with the insulating spacer 121 may include guides 135, 145, 152, and 162 covering the outer circumference of the insulating spacer 121 made of ceramic, respectively. In bonding with the adhesive substance 122, the guide 162 allows them to be aligned and bonded in one line. For the cathode 130, the gate 140, or the first and second focusing electrodes 150 and 160, the insulating spacer 121 prevents the charge from stacking due to the hitting of the electrons by reducing the exposed area of the inner surface of the insulating spacer 121 as much as possible while maintaining a sufficient gap between the electrodes.

The cathode 130 and the gate 140 include the cathode electrode 133 and the gate electrode 143, respectively. Thread taps 134, 144, 151, and 161 are formed on the outer side of the cathode electrode 133, the gate electrode 143, and the first and second focusing electrodes 150 and 160. The thread taps 134, 144, 151, and 161 facilitate connection with an external power source.

Meanwhile, the metallic components, except for the anode electrode 193, the anode target 191, the window 181, and the spacer unit 120, may be made of a Kovar alloy having a coefficient of thermal expansion similar to that of ceramic.

Figure 3:
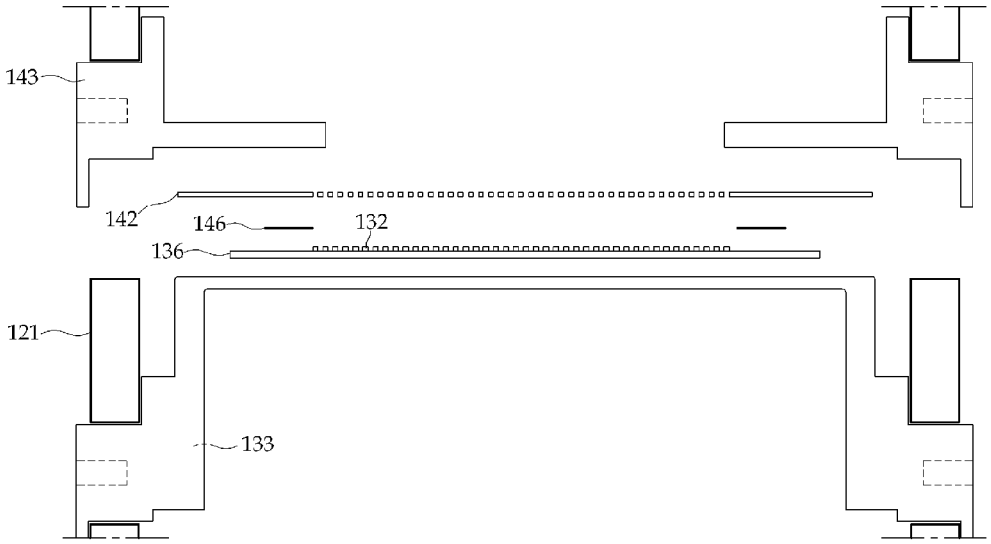
FIG. 3 is a structural view illustrating an exemplary embodiment of a stacked structure between a cathode and a gate using a spacer according to an exemplary embodiment of the present disclosure.

FIG. 3 is a view illustrating an exemplary embodiment of a stacked structure between a cathode and a gate using a spacer according to an exemplary embodiment of the present disclosure.

A stacked structure between the cathode 130 and the gate 140 which uses a spacer is described hereafter.

In detail, the cathode 130 includes the cathode electrode 133, the cathode substrate 136, and the field emitter 132. Meanwhile, the gate 140 includes the gate electrode 143, the gate hole 142, and the insulating spacer 146.

A process of forming the stacked structure between the cathode 130 and the gate 140 is described hereafter.

The cathode substrate 136 is formed on the cathode electrode 133.

The field emitter 132 is formed on the cathode substrate 136.

Thereafter, the insulating spacer 146 is inserted into between the field emitter 132 and the gate hole 142.

The gate hole 142 is formed above the insulating spacer 146.

The gate hole 142 is combined with the gate electrode 143.

When the parts are stacked through this process, the gap between the gate hole 142 and the field emitter 132 is fixed and kept constant by the insulating spacer 146.

Figure 4:
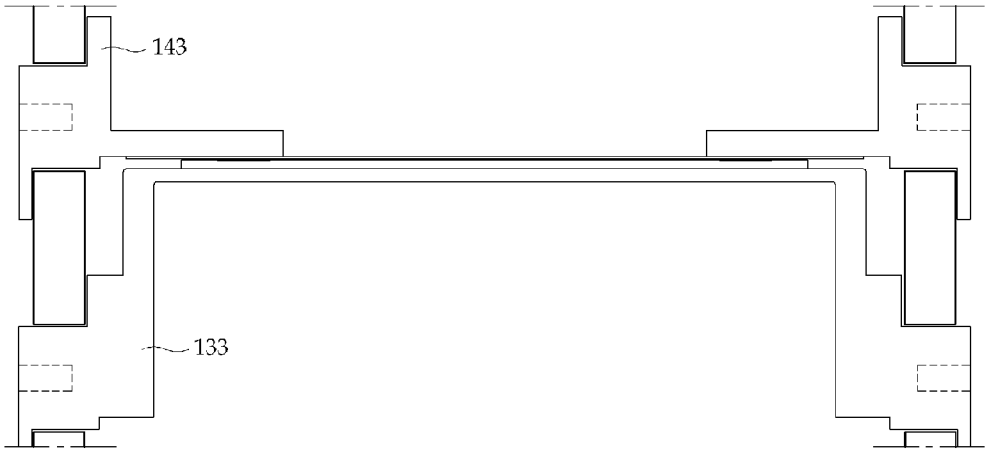
FIG. 4 is a detailed structural view illustrating an exemplary embodiment of a stacked structure between a cathode and a gate using a spacer according to an exemplary embodiment of the present disclosure.

FIG. 4 is a detailed structural view illustrating an exemplary embodiment of a stacked structure between a cathode and a gate using a spacer according to an exemplary embodiment of the present disclosure.

FIG. 4 illustrates in detail the cathode 130 and the gate 140 combined in a layers shape, as described above with reference to FIG. 3.

The field emitter 132, the spacer 146, and the gate hole 142 are sequentially stacked. The x-ray tube apparatus 10 with various electrodes makes it possible to reduce the size of the x-ray tube while maintaining the electric insulation through the stacked shape.

According to the present disclosure, it is possible to reduce the size of an x-ray tube by forming a stacked structure, with electric insulation and predetermined gaps maintained of each electrode, by manufacturing an x-ray tube having a stacked structure by inserting insulating spacers (for example, ceramic) between a exhausting port, a cathode, a gate, a focusing electrode, and an anode and bonding them with an adhesive substance, and then inserting a spacer between a field emitter on a cathode substrate and a gate hole connected with a gate electrode. Therefore, it is possible to not only sufficiently put apparatuses where the present disclosure is applied, on the market or do business, but uses the present disclosure for the related technologies, beyond the existing technical limit, and actually and definitely achieves the present disclosure, such that the present disclosure may be considered to have industrial applicability.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A stacked x-ray tube apparatus using a spacer, comprising:

a cathode including a cathode electrode, a cathode substrate and a field emitter formed on the cathode substrate, the cathode emitting electrons through the field emitter;

a gate configured to apply an electric field to the field emitter through a gate electrode with a gate hole;

a focusing electrode configured to focus electrons generated from the cathode;

an anode configured to generate x-rays when the focused electrons hit on an anode target; and a plurality of insulating spacers including:

a first insulating spacer disposed between the cathode electrode and the gate electrode to maintain a predetermined gap between the cathode electrode and the gate electrode, and a second insulating spacer inserted between the field emitter and the gate hole to maintain a predetermined gap between the field emitter and the gate hole.

2. The apparatus of claim 1, further comprising an exhausting unit configured to exhaust air through the space between the anode and the cathode.

3. The apparatus of claim 2, wherein the exhausting pipe is a glass pipe or an oxide free copper pipe.

4. The apparatus of claim 2, wherein the air in the space between the gate electrode and the anode electrode is exhausted to the exhausting pipe through exhausting holes formed at the gate electrode and the cathode electrode, respectively.

5. The apparatus of claim 2, wherein the plurality of spacers further includes a third insulating spacer between the exhausting unit and the cathode electrode, wherein the cathode electrode includes a portion extended downward covering an outer circumference of the third insulating spacer, and wherein the gate electrode includes a portion extended downward covering an outer circumference of the first insulating spacer.

6. The apparatus of claim 1, wherein the insulating spacers are made of ceramic.

7. The apparatus of claim 1, wherein the insulating spacers are bonded with the cathode, the gate, the focusing electrode, and the anode by the adhesive substance made of frit glass or a brazing filler.

8. The apparatus of claim 1, wherein the cathode electrode, the gate electrode, or the focusing electrode is made of a Kovar alloy.

9. The apparatus of claim 1, wherein the anode further includes an anti-back scattering cap with a hole passing the focused electrons.

10. The apparatus of claim 1, wherein the anode target is made of tungsten or molybdenum.

11. The apparatus of claim 1, wherein the focusing electrode includes a first electrode and a second electrode, and the insulating spacers further include a fourth insulating spacer between the gate electrode and the first electrode and a fifth insulating spacer between the first electrode and the second electrode, the fourth insulating spacer has an outer circumferential surface exposed to an outside, a lower surface in contact with the gate electrode and an upper surface in contact with the second electrode, and the fifth insulating spacer has an outer circumferential surface exposed to the outside, a lower surface in contact with the first electrode and an upper surface in contact with the second electrode.

12. The apparatus of claim 11, wherein the first electrode includes:

a first outer circumferential surface exposed to the outside, an upper surface extending inward from the first circumferential surface and in contact with the lower surface of the fifth insulating spacer, and a second outer circumferential surface extending upward from the upper surface and covering and in contact with an inner circumferential surface of the fifth insulating spacer.

13. The apparatus of claim 11, wherein the insulating spacers further include a sixth insulating spacer between the second electrode and the anode, and the sixth insulating spacer includes an outer circumferential surface exposed to the outside, a lower surface in contact with and covered by the second electrode, and an inner circumferential surface.

14. The apparatus of claim 13, wherein the second electrode includes:

a first outer circumferential surface exposed to the outside, an upper surface extending inward from the first circumferential surface and in contact with the lower surface of the sixth insulating spacer, and a second outer circumferential surface extending upward from the upper surface and covering and in contact with the inner circumferential surface of the sixth insulating spacer.

* * * * *